US006698260B2

(12) United States Patent
Su

(10) Patent No.: US 6,698,260 B2
(45) Date of Patent: Mar. 2, 2004

(54) INTERIORLY REINFORCED DOOR LOCK SET

(76) Inventor: Frank Su, 2Fl., No. 162-4, King-Hua Street, Ta-An District, Taipei (TW)

( * ) Notice: Subject to any disclaimer, the term of this patent is extended or adjusted under 35 U.S.C. 154(b) by 84 days.

(21) Appl. No.: 10/071,317

(22) Filed: Feb. 6, 2002

(65) Prior Publication Data

US 2003/0145638 A1 Aug. 7, 2003

(51) Int. Cl.[7] ..... E05B 9/08

(52) U.S. Cl. ..... 70/134; 70/370; 70/451; 292/356; 292/357

(58) Field of Search ..... 70/224, 370, 134, 70/448, 449, 451, 466; 292/356, 357

(56) References Cited

U.S. PATENT DOCUMENTS 3,550,411 A * 12/1970 Neary et al. ..... 70/370
4,073,172 A * 2/1978 Schlage ..... 70/417
5,556,144 A * 9/1996 Lin ..... 292/336.3
5,657,653 A * 8/1997 Hensley et al. ..... 70/224
5,722,273 A * 3/1998 Lin et al. ..... 70/370
5,761,936 A * 6/1998 Katayama ..... 70/224
5,845,522 A * 12/1998 Shen ..... 70/224
5,906,125 A * 5/1999 Shen ..... 70/370
5,950,467 A * 9/1999 Dong ..... 70/467
6,279,360 B1 * 8/2001 Shen ..... 70/224
6,425,273 B1 * 7/2002 Kim et al. ..... 70/224
6,497,126 B2 * 12/2002 Wang ..... 70/472

* cited by examiner

*Primary Examiner*—Lloyd A. Gall

(57) ABSTRACT

A door lock set includes: an outer lock held in an outer trim plate on an outside surface of a door, a latch device for locking the door on a door frame, an inner reinforced retaining member fastened with the outer lock and retained on an inside surface of the door, an outer reinforced retaining member fastened with the inner reinforced retaining member across the door, an inner trim plate having an inner knob or handle rotatably or pivotally held on the inner trim plate fastened to the inner reinforced retaining member and retained on an inside surface of the door; and the outer lock fastened to the inner reinforced retaining member for retaining the outer trim plate on the outside surface of the door for providing a door lock set easily assembled but difficultly damaged.

1 Claim, 3 Drawing Sheets

INTERIORLY REINFORCED DOOR LOCK SET

BACKGROUND OF THE INVENTION

A conventional door lock set includes: an outer lock held on an outer trim plate retained on an outside surface of a door, a locking bolt slidably held in a central portion of the lock set for locking a door on a door frame upon locking of the outer lock, an inner knob or handle rotatably or pivotally formed on an inner trim plate retained on an inside surface of the door, having a spindle axially linked between the outer lock and the inner knob.

However, the conventional door lock set can be easily damaged or destroyed intentionally by an intruder. Meanwhile, when assembling the three major parts of the conventional door lock set, namely (a) the outer trim plate having outer lock held thereon, (b) the inner trim plate having inner knob formed thereon, and (c) the locking bolt perpendicularly connected to the spindle, as directed from three directions including an outside surface of the door (first direction), an inside surface of the door (second direction) and the end surface facing the door frame (third direction), it may cause difficulty for assembling these parts from three directions and also requiring skill for stably positioning or supporting the parts whenever assembling the lock set.

The present inventor has found the drawbacks of the conventional door lock set and invented the present door lock set as interiorly reinforced.

SUMMARY OF THE INVENTION

The object of the present invention is to provide a door lock set including: an outer lock held in an outer trim plate positioned on an outside surface of a door, a latch device retained in the door for protruding a latch for locking the door on a door frame, an inner reinforced retaining member fastened with the outer lock and retained on an inside surface of the door, an outer reinforced retaining member fastened with the inner reinforced retaining member across the thickness of the door, an inner trim plate having an inner knob or handle rotatably or pivotally held on the inner trim plate fastened to the inner reinforced retaining member and retained on an inside surface of the door; with the inner knob coaxially linked with the outer lock by a spindle connected with the latch device for operatively protruding the latch for locking the door; and the outer lock fastened to the inner reinforced retaining member for retaining the outer trim plate on the outside surface of the door, thereby providing a door lock set easily assembled but difficultly damaged.

DETAILED DESCRIPTION

Figure 1:
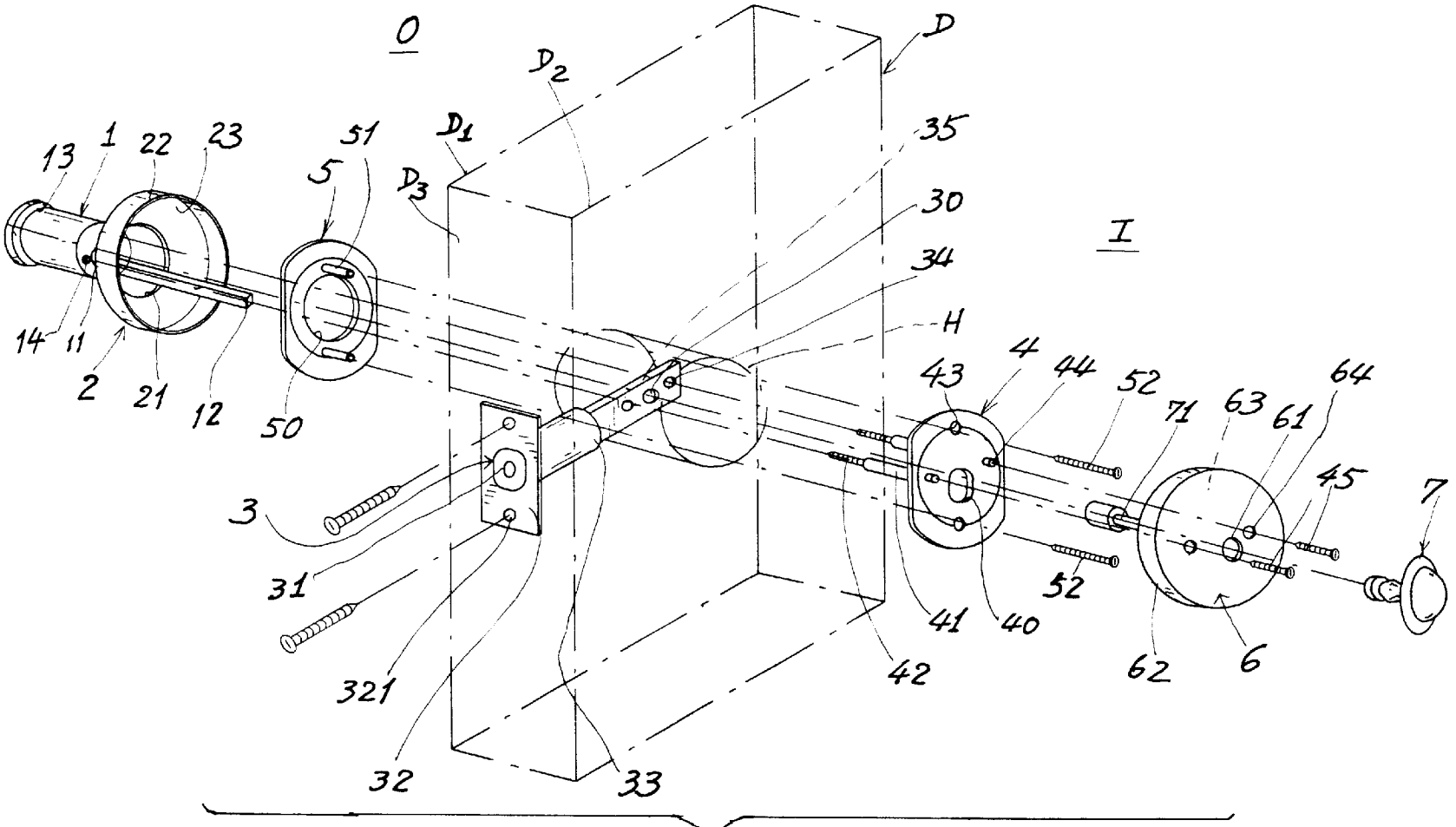
FIG. 1 is an exploded view showing the elements of the present invention.
Figure 2:
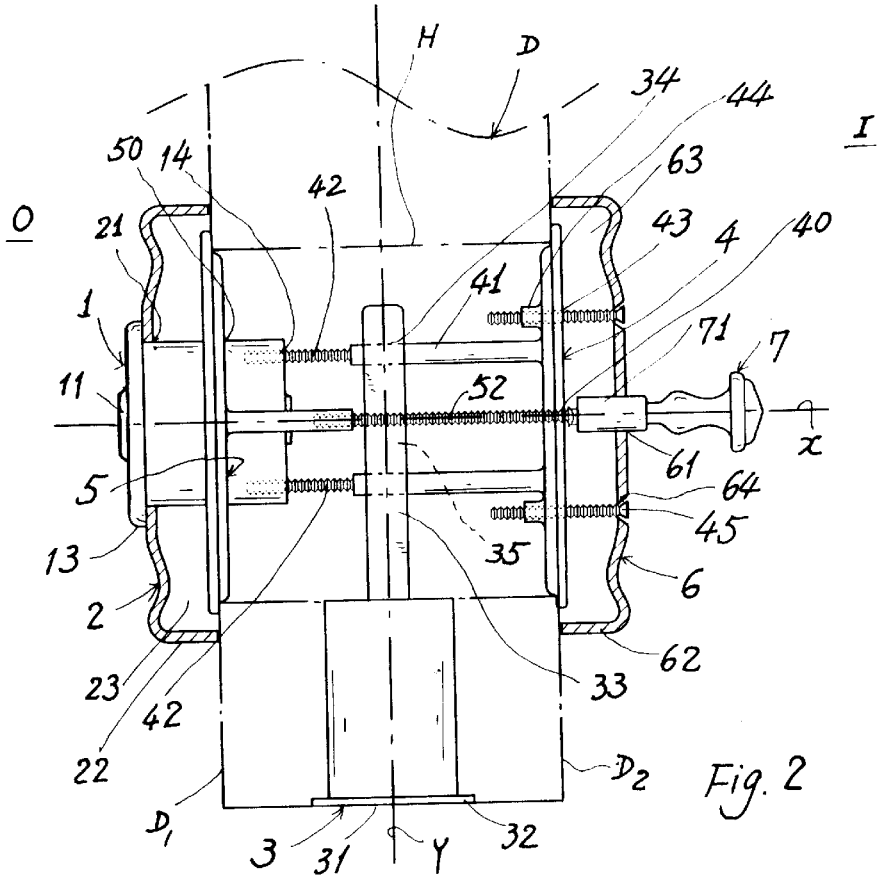
FIG. 2 is a top-view (partial sectional) illustration of the present invention when assembled.
Figure 3:
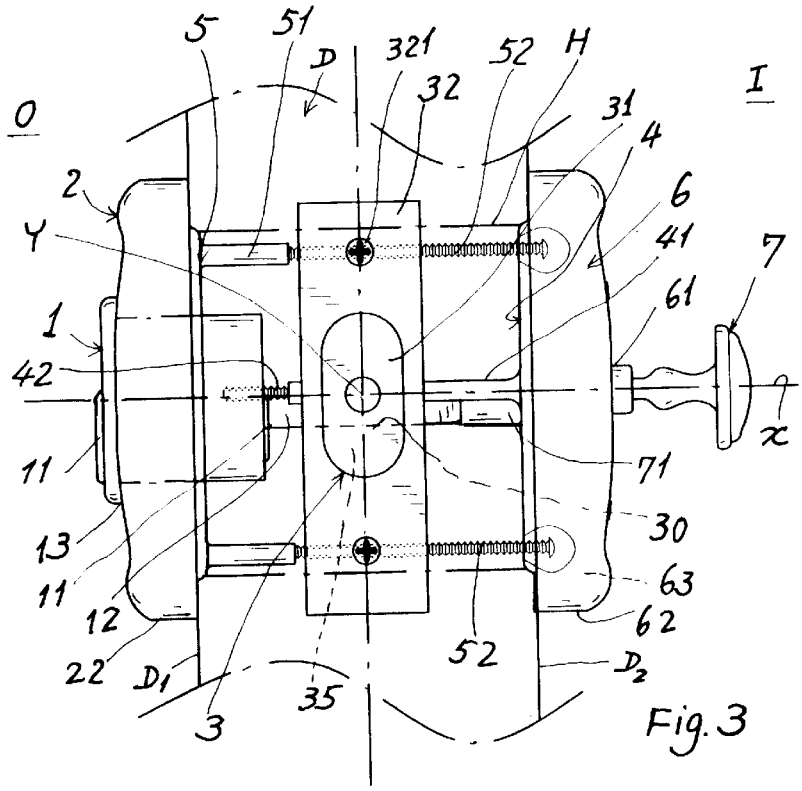
FIG. 3 is a front-view illustration of the present invention when assembled.

As shown in FIGS. 1–3, the door lock set of the present invention comprises: an outer lock 1 formed on an outside (O) of a door D and protruding inwardly through a lock hole H formed through a thickness of the door, an outer trim plate 2 having the outer lock 1 held therein and retained on an outside surface D1 of the door D, a latch device 3 formed in the door D adjacent to a locking end wall D3 of the door D and driven by the outer lock 1 for protruding a latch 31 for locking the door on a door frame (not shown), an inner reinforced retaining member 4 fastened with the outer lock 1 for retaining the outer trim plate 2 on the outside surface $D_1$ of the door D and the inner reinforced retaining member 4 retained on an inside surface D2 of the door D, an outer reinforced retaining member 5 fastened with the inner reinforced retaining member 4 across a thickness of the door D, an inner trim plate 6 fastened to the inner reinforced retaining member 4 and retained on the inside surface D2 of the door D, and an inner knob (or handle) 7 rotatably (or pivotally) held on the inner trim plate 6 inside (I) the door and coaxially linked with the outer lock 1 by a spindle 12 about a longitudinal axis X defined at a longitudinal center of the outer lock 1 and the inner knob 7; with the latch device 3 defining a latitudinal axis Y at a center thereof to be projectively perpendicular to the longitudinal axis X between the outer lock 1 and the inner knob 7.

The outer lock 1 includes: a locking core 11 rotatably held in the outer lock 1, a spindle 12 connected to the locking core 11 and linked to a sleeve 71 of the inner knob 7, a flange 13 circumferentially formed on an outer periphery of the outer lock and disposed about a circular edge portion of a central lock hole 21 formed in the outer trim plate 2, for retaining the outer trim plate 2 on the outside surface D1 of the door D, and two (or a plurality of) screw holes 14 formed in an inner portion of the outer lock 1 for engaging two (or plural) fastening screws 42 rotatably held in the inner reinforced retaining member 4.

The latch device 3 includes: a latch 31 slidably held in an end plate 32 fixed on a locking end wall D3 of the door D adjacent to a door frame by fixing screws through the screw holes 321 formed in the end plate 32, a casing 33 connected with the end plate 32 also for slidably holding the latch 31 therein about the latitudinal axis Y, two (or a plurality of) sleeve holes 34 formed in the casing 33 for passing two (or plural) sleeves 41 integrally formed on the inner reinforced retaining member 4 through the sleeve holes 34 to thereby stably position the latch device 3 in between an outside O and an inside I of the door D, and a driving mechanism 35 (of which the details are not shown) formed in the casing 33 and connected with the spindle 12 as linked between the outer lock 1 and the inner knob 7 for operatively protruding the latch 31 outwardly from the casing 33 and the end plate 32 for locking the door on the door frame, with the spindle 12 passing through a spindle hole 30 formed through the casing 33.

The inner reinforced retaining member 4 includes: a central hole 40 for passing the sleeve 71 of the inner knob 7, two (or a plurality of) outer sleeves 41 protruding towards the outside surface D1 of the door from the inner reinforced retaining member 4, two (or a plurality of) fastening screws 42 each passing through each outer sleeve 41 and engaging with each screw hole 14 formed in the outer lock 1 for fastening the outer lock 1 and the outer trim plate 2 with the inner reinforced retaining member 4 to be respectively retained on the outside surface D1 and the inside surface D2 of the door D, two (or a plurality of) screw holes 43 formed in the inner reinforced retaining member 4 for engaging two (or plural) fastening screws 52 of the outer reinforced retaining member 5 contiguous to the outer trim plate 2, and two (or plural) female-threaded sockets 44 formed on the inner reinforced retaining member 4 for engaging two (or plural) inner fastening screws 45 passing through the inner trim plate 6 for fastening the inner trim plate 6 with the inner reinforced retaining member 4 for retaining the inner trim plate 6 on the inside surface D2 of the door D.

The outer trim plate 2 includes a lock hole 21 formed in a central portion of the outer trim plate 2 for protruding the outer lock 1 inwardly through the lock hole 21, a skirt portion 22 circumferentially formed on a periphery of the outer trim plate 2 to be retained on the outside surface D1 of the door D defining an interior 23 within the skirt portion 22 and the outer trim plate 2 for receiving the outer reinforced retaining member 5 in the interior 23 of the outer trim plate 2.

The inner trim plate 6 includes a central hole 61 for passing a central sleeve 71 of the inner knob 7 for connecting the spindle 12 with the central sleeve 71, a skirt portion 62 circumferentially formed on a periphery of the inner trim plate 6 to be retained on the inside surface D2 of the door D, two (or a plurality of) screw holes (64) formed in the inner trim plate 6 for engaging two (or plural) fastening screws 45 through the screw holes 64 for fastening the inner trim plate 6 with the inner reinforced retaining member 4 and for retaining the inner trim plate 6 on the inside surface D2 of the door D; with the skirt portion 62 defining an interior 63 for receiving the inner reinforced retaining member 4 in the interior of the inner trim plate 6.

The outer reinforced retaining member 5 includes: a central lock hole 50 for engaging the outer lock 1, two (or a plurality of) female-threaded sleeves 51 protruding from the outer reinforced retaining member 5 towards the inside I of the door D for engaging two (or plural) fastening screws 52 in the two female-threaded sleeves 51 for coupling the inner reinforced retaining member 4 to thereby firmly fasten the outer and inner reinforced retaining members 5, 4 in between the outside and inside surfaces D1, D2 of the door D (across the thickness of door).

Accordingly, the present invention provides a safe and strong locking device for a door lock set with the following advantages superior to the conventional door lock set:

1. The outer lock 1 and outer trim plate 2 are further reinforced by an outer reinforced retaining member 5 to prevent from an easy intrusion by an intruder by breaking the outer trim plate.
2. Both the outer and inner reinforced retaining members 5, 4 are firmly coupled and fastened on opposite side surfaces D1, D2 of the door D for stably, strongly and reliably securing the door lock set on a door.
3. The latch device 3 has been "carried" on the two sleeves 41 of the inner reinforced retaining member 4 during the installation of the lock set of the present invention, not freely pendulously held on the spindle 12, so that the latch device 3 can be conveniently secured on the end wall D3 of the door D. Similarly, the elements of the present invention seem to be "mounted" on a frame (like a building frame for an architecture building) during the installation or assembly of the lock set, thereby enhancing or facilitating the installation of the door lock set.

Figure 4:
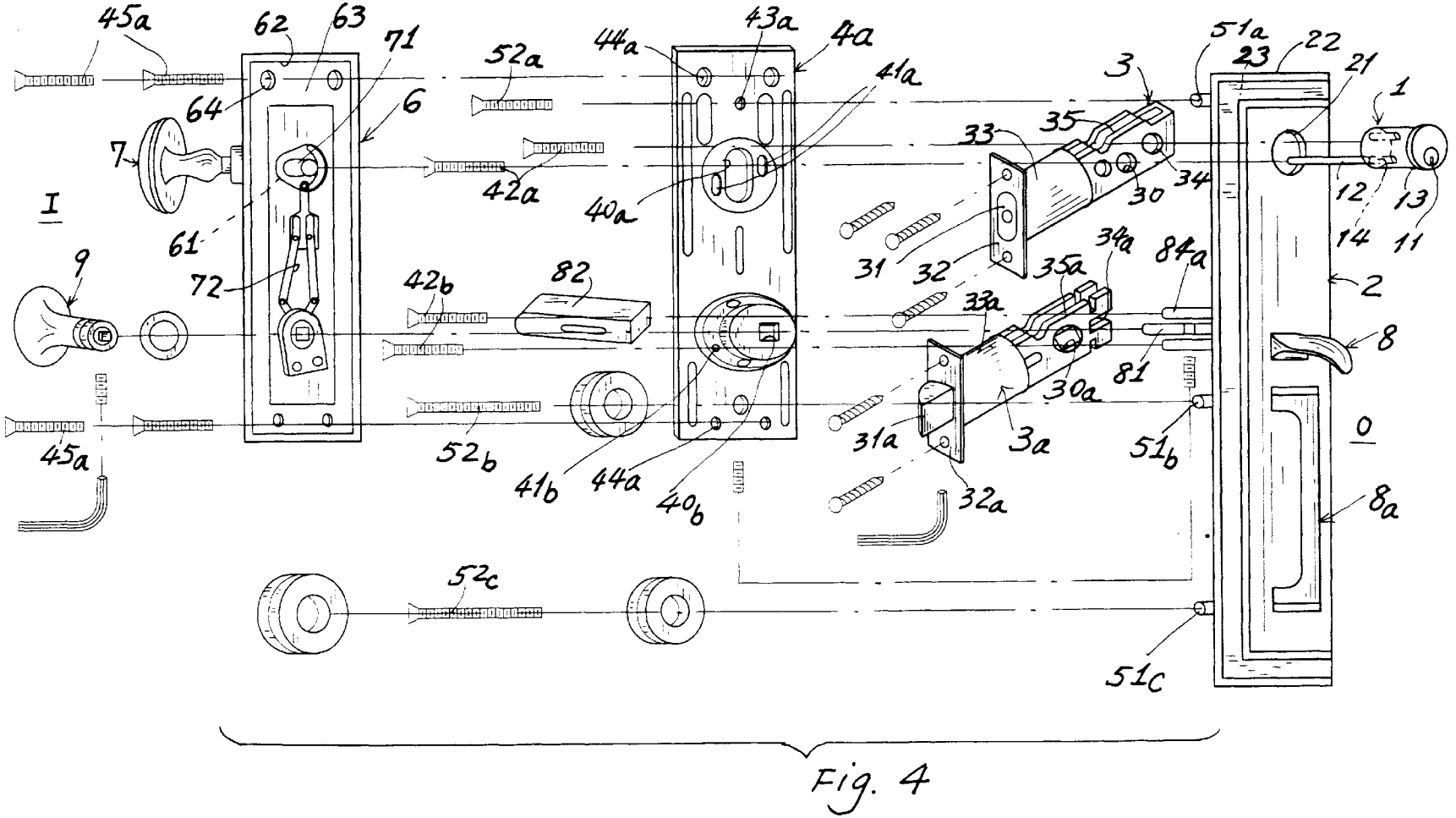
FIG. 4 is an exploded view showing another preferred embodiment of the present invention.

Another preferred embodiment of the present invention is shown in FIG. 4, in which either inner or outer trim plate has been modified to be longer; the reinforced retaining members simplified to be a unique one and an additional (lower) latch device provided. The upper latch 3 of FIG. 4 can be referred to a dead bolt, while the lower latch 3*a* can be referred to a latch bolt, but not limited in the present invention.

The door lock set as shown in FIG. 4 comprises: an outer lock 1, an outer trim plate 2 formed as rectangular or elliptic shape as retained on an outside surface of a door and having the outer lock 1 secured in an upper portion of the outer trim plate 2, an upper latch device 3 linked with the outer lock 1 for protruding an upper latch (or dead bolt) 31 for locking the door on a door frame, an interior reinforced retaining member 4*a* provided in the door and fastened to the outer trim plate 2 to dispose ("sandwich") the upper latch device 3 in between the outer trim plate 2 and the interior reinforced retaining member 4*a*, an inner trim plate 6 fastened to the interior reinforced retaining member 4*a* and retained on an inside surface of the door, an inner upper knob 7 rotatably mounted in an upper portion of the inner trim plate 6 and linked with the outer lock 1, an outer handle 8 pivotally mounted on a lower portion of the outer trim plate 2, a lower latch device 3*a* resiliently extending a lower latch (or latch bolt) 31*a* for closing the door and connected with the outer handle 8 for operatively retracting the lower latch 31*a* when opening the door and sandwiched between the interior reinforced retaining member 4*a* and the outer trim plate 2, and an inner lower handle (or knob) 9 rotatably mounted in a lower portion of the inner trim plate 6 and linked with the lower latch device 3*a* for operatively retracting the lower latch 31*a* when opening the door.

The upper latch device 3 has the same mechanism and numerals of the elements as shown in FIGS. 1–3; while the lower latch device 3*a* has the elements corresponding to that of the upper latch device 3 but with numerals each added with a letter "a", for instance, "31*a*" indicating the lower latch.

The outer trim plate 2 has a fixed handle 8*a* formed on a lower portion of the plate 2 for user's grip use.

The inner upper knob 7 is coupled to the inner lower handle 9 by a link 72, whereby upon rotation of either upper knob 7 or lower handle 9, each latch 31 or 31*a* can be operated for locking or unlocking the door. However, they are conventional art, not described in detail in this invention.

The interior reinforced retaining member 4*a* includes: two (or plural) screw holes 41*a* for engaging two (or plural) fastening screws 42*a*, which are engageable with two screw holes 14 formed in the outer lock 1 by passing through two holes 34 formed through the upper latch device 3, for fastening the interior reinforced retaining member 4*a* with the outer lock 1; with the outer lock 1 having a flange 13 circumferentially formed on an outer periphery of the outer lock 1 for retaining the outer trim plate 2 on an outside surface of the door; an upper spindle hole 40*a* formed in an upper portion of the retaining member 4*a* for passing an upper spindle 12 linked between the outer lock 1 and the inner knob 7, a plurality of screw holes 44*a* formed through the retaining member 4*a* for engaging a plurality of fastening screws 45*a*, passing through plural holes 64 formed through the inner trim plate 6, for fastening the inner trim plate 6 with the interior reinforced retaining member 4*a* for retaining the inner trim plate 6 on an inside surface of the door; a plurality of screw holes 43*a* formed through the retaining member 4*a* for passing a plurality of fastening screws 52*a*, 52*b* which are engaged with a plurality of screw sleeves 51*a*, 51*b* formed on an inside surface of the outer trim plate 2 for firmly fastening the interior reinforced retaining member 4*a* with the outer trim plate 2; with an additional fastening screw 52*c* secured in the door (not shown) and fastened to the lower sleeve 51*c* formed on a lower portion of the outer trim plate 2 for firmly securing the lower portion of the outer trim plate 2 to the door in cooperation with the other two screws 52*a*, 52*b* as abovementioned; two (or plural) screw holes 41*b* formed in the lower portion of the retaining member 4*a* for engaging two (or plural) fastening screws 42*b*, which are engaged with sleeves 84*a* formed on an inside surface of the outer trim plate 2 adjacent to the outer handle 8 when passing through holes 34*a* formed in the lower latch device 3*a* for fastening the retaining member 4*a* (especially the lower portion of the member 4*a*) with the outer trim plate 2 (especially the middle portion of the plate 2); and a lower spindle hole 40*b* formed through the lower portion of the member 4*a* for passing the lower spindle 82 linked between the inner lower handle 9 and a driving arm 81 of the outer handle 8 (the lower spindle hole 40*b* may be formed in a hub rotatably mounted in the lower portion of the member 4*a*).

If the lower elements such as the lower latch device 3*a*, the outer handle 8, the inner lower handle (or knob) 9 as shown in FIG. 4 are eliminated, the interior reinforced retaining member 4*a* may then be shortened, and both the trim plates 2, 6 may also be shortened.

Similarly, if the interior reinforced retaining member 4*a* as shown in FIG. 4 is eliminated and substituted with the inner and outer reinforced retaining members 4, 5 as shown in FIGS. 1–3, with the inner and outer retaining members 4, 5 being modified to be rectangular in shape to be corresponding to the rectangular inner and outer plates 6, 2 as shown in FIG. 4, the upper and lower latch devices 3, 3*a* as sandwiched between the inner and outer plates 6, 2 will be strongly reinforced and safely protected by the inner and outer reinforced retaining members.

So, the present invention may be modified without departing from the spirit and scope of the present invention.

I claim:

1. A door lock set comprising:

an outer lock formed on an outside of a door and protruding inwardly through a lock hole formed through a thickness of the door; said outer lock including: a locking core rotatably held in the outer lock, a spindle connected to the locking core, a flange circumferentially formed on an outer periphery of the outer lock and two screw holes formed in an inner portion of the outer lock an outer trim plate having a circular edge portion formed around a central lock hole in said outer trim plate and disposed about by said flange of the outer lock for retaining the outer trim plate on an outside surface of the door; a latch device formed in the door and driven by said outer lock for protruding a latch for locking the door on a door frame; said latch device including: said latch slidably held in an end plate fixed on a locking end wall of the door adjacent to a door frame, a casing connected with the end plate for slidably holding the latch therein about a latitudinal axis defined at a center of said latch, two sleeve holes formed in the casing, and a driving mechanism formed in the casing and connected with the spindle as linked between the outer lock and an inner knob for operatively protruding the latch outwardly from the casing and the end plate for locking the door on the door frame an inner reinforced retaining member fastened with the outer lock to be retained on an inside surface of the door; said inner reinforced retaining member including: a central hole for mounting the inner knob, two outer sleeves protruding from the inner reinforced retaining member, through the sleeve holes formed in said casing of said latch device, to stably position said latch device between an outside and inside of the door, towards the outside surface of the door, two outer fastening screws each passing through each said outer sleeve and engaging with each of two screw holes formed in the outer lock for fastening the outer lock and the outer trim plate with the inner reinforced retaining member to be respectively retained on the outside surface and the inside surface of the door, two holes formed in the inner reinforced retaining member, and two female-threaded sockets formed on the inner reinforced retaining member;

an outer reinforced retaining member encased in said outer trim plate and fastened with said inner reinforced retaining member across the thickness of said door for firmly fastening said outer and inner reinforced retaining members in between the outside and inside surfaces of said door and for retaining said outer trim plate on said outside surface of said door; said outer reinforced retaining member including: a central lock hole for engaging the outer lock, two female-threaded sleeves protruding from the outer reinforced retaining member towards the inside of the door for engaging two fastening screws, as rotatably engaging with the two holes formed in said inner reinforced retaining member, in the two female-threaded sleeves of said outer reinforced retaining member for coupling and fastening the inner and outer reinforced retaining members in between the outside and inside surfaces of the door;

an inner trim plate having two inner fastening screws passing through said inner trim plate to be engaged with the two female-threaded sockets formed on said inner reinforced retaining member to be fastened to said inner reinforced retaining member and retained on the inside surface of said door for encasing said inner reinforced retaining member in said inner trim plate; and said inner knob rotatably or pivotally formed on said inner trim plate and linked with said outer lock by said spindle passing through said latch device positioned between the outer and inner trim plates; and both said outer and inner reinforced retaining members disposed on opposite side surfaces of said door for shielding the lock hole formed through the thickness of said door for preventing intrusion into the lock hole from said outer trim plate;

whereby upon fastening of both said inner and outer reinforced retaining members on said door, said door lock set is strongly reinforced and well supported.

* * * * *